US009643067B2

(12) United States Patent
Snyder

(10) Patent No.: US 9,643,067 B2
(45) Date of Patent: May 9, 2017

(54) TRAINER

(76) Inventor: Scott Snyder, Morristown, NJ (US)

( * ) Notice: Subject to any disclaimer, the term of this patent is extended or adjusted under 35 U.S.C. 154(b) by 0 days.

(21) Appl. No.: 13/594,584

(22) Filed: Aug. 24, 2012

(65) Prior Publication Data

US 2015/0091253 A1 Apr. 2, 2015

(51) Int. Cl.

| | |
|---|---|
| ***A63B 63/00*** | (2006.01) |
| ***A63B 63/08*** | (2006.01) |
| ***A63B 67/06*** | (2006.01) |
| ***A63F 7/00*** | (2006.01) |

(52) U.S. Cl.

CPC ..... *A63B 63/08* (2013.01); *A63B 67/06* (2013.01); *A63F 7/0017* (2013.01); *A63B 63/00* (2013.01); *A63B 2063/001* (2013.01); *A63B 2063/002* (2013.01); *A63B 2209/08* (2013.01); *A63B 2209/10* (2013.01); *A63B 2210/50* (2013.01); *A63F 2250/024* (2013.01)

(58) Field of Classification Search

CPC ..... A63B 67/06; A63B 63/08; A63B 63/00; A63B 67/002; A63B 2063/001; A63F 2250/024; A63F 7/0017

USPC ..... 273/398–402, 342

See application file for complete search history.

(56) References Cited

U.S. PATENT DOCUMENTS

| | | | | | |
|---|---|---|---|---|---|
| 593,343 | A * | 11/1897 | Whitney | 273/400 |
| 2,744,752 | A * | 5/1956 | Arnold | 273/398 |
| 3,322,426 | A * | 5/1967 | Zulkoski | 273/396 |
| 3,495,830 | A * | 2/1970 | Farrelli | 273/400 |
| D258,366 | S * | 2/1981 | Ward | D21/303 |
| D380,500 | S * | 7/1997 | Cusumano | D21/303 |
| 5,704,612 | A * | 1/1998 | Kelly et al. | 273/402 |
| 6,142,890 | A * | 11/2000 | Craig | 473/472 |
| 7,805,959 | B2 * | 10/2010 | Webb et al. | 62/457.3 |
| 7,845,644 | B2 * | 12/2010 | Constantine et al. | 273/317.6 |
| 8,028,995 | B2 * | 10/2011 | Hoffer | 273/342 |
| 8,146,921 | B2 * | 4/2012 | Lombardi | 273/342 |
| 2012/0013073 | A1 * | 1/2012 | Wyland | 273/287 |
| 2012/0032402 | A1 * | 2/2012 | Comee | 273/397 |
| 2012/0169012 | A1 * | 7/2012 | Parker et al. | 273/400 |
| 2012/0225742 | A1 * | 9/2012 | Max et al. | 473/481 |

* cited by examiner

*Primary Examiner* — Mark Graham

(57) ABSTRACT

A trainer is disclosed which is useful for developing skill in sports of coordination including for instance beer-pong.

9 Claims, 14 Drawing Sheets

FIG. 3a
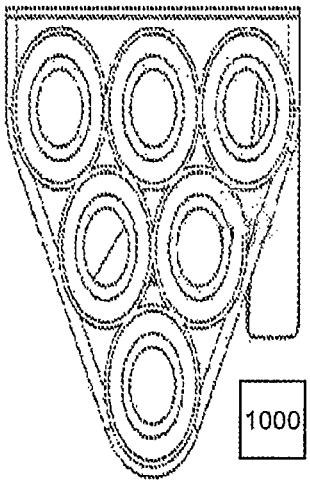
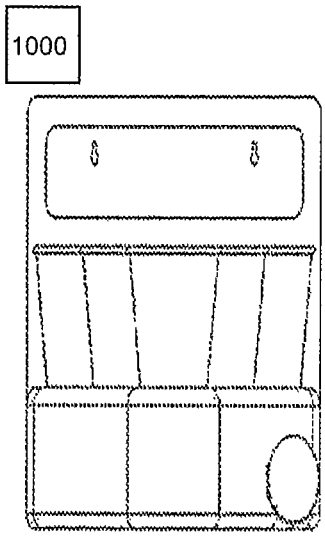
FIG. 3b
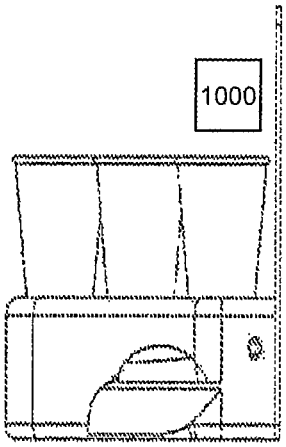
FIG. 3c

BROKEN-OUT SECTION

FIG. 9a
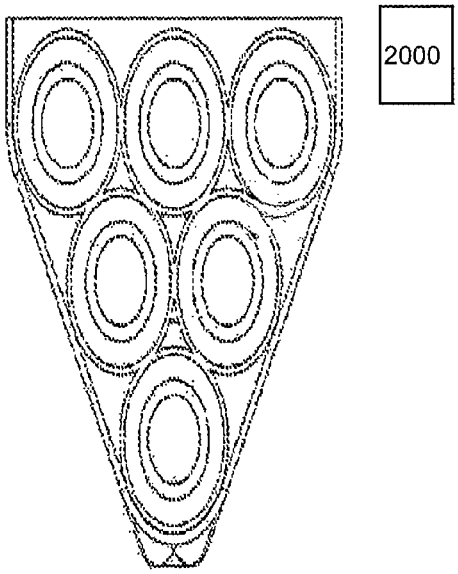
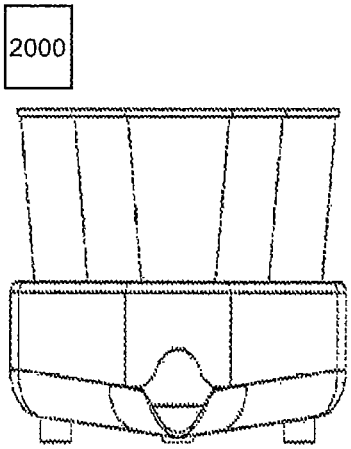
FIG. 9b
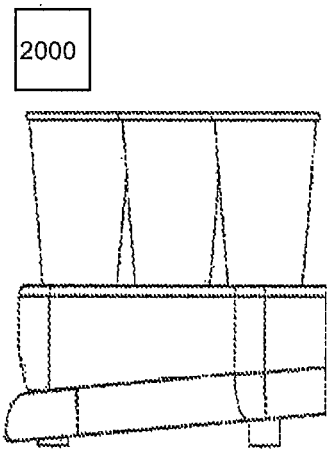
FIG. 9c

TRAINER

CLAIM OF PRIORITY

This is the first filing made with the USPTO by the applicant regarding the present disclosure.

BACKGROUND/FIELD

Tossing games of skill including for instance Beirut and Beer-Pong require coordination and skill on the part of the play. Such skill and coordination may be improved with practice and training. Further, the games of Beirut and Beer-Pong raise known sanitary concerns as balls in play are often in contact with both the ground of a playing room as well as beverages to be consumed by the players.

Consequently, devices are provided herein that provide for both training and sanitary play of the games Beirut, Beer-Pong, and other tossing games of skill.

SUMMARY

According to certain embodiments of the present disclosure, a trainer comprises; a plurality of tubes having substantially circular tangential and co-planar apertures disposed at the dorsal end-portions thereof, with the interior volume of the tubes in communication with a tray; wherein a distal-end portion of the tray is elevated relative to a proximal-end portion of the tray such that a ball entering one of the apertures will travel eventually to the proximal-end portion of the tray.

According to further embodiments of the present disclosure, the tubes are removable from the tray by means of magnets, hook and loop fasteners, press fitting, a bayonette mount, or a thread.

According to further embodiments of the present disclosure, the tray is disposed within a hollow volume, thereby defining a base.

According to further embodiments of the present disclosure, there is an aperture disposed upon the surface of the base in communication with the tray and apertures at the dorsal ends of the tubes thereby defining an exit such that a ball released in an entrance will eventually fall and roll to the exit.

According to further embodiments of the present disclosure, the exit is disposed centrally to the proximal-end portion of the base.

According to further embodiments of the present disclosure, the exit is disposed upon opposing, lateral sides of the base.

According to further embodiments of the present disclosure, the color of the tubes is selected to approximate the red, blue, or white of Solo Plastic Party Cold® drinking cups.

According to further embodiments of the present disclosure, the tubes have an inverse frustoconical taper, with the taper being selected from the range of 1 and 30 degrees from long axis of each tube.

According to further embodiments of the present disclosure, the diameter of a given tube is between the range of 1 and 4 inches.

According to further embodiments of the present disclosure, the diameter of a given tube is selected to approximate that of a 20 ounce, 16 ounce, 12 ounce, 10 ounce, 9 ounce, or 8 ounce Solo Plastic Party Cold® drinking cup.

According to further embodiments of the present disclosure, there are contact points disposed upon the ventral end portion of the base for stabilizing the trainer with the contact points comprising one of the following; screw holes, suction cups, adhesive pads, foam pads, or rigid pads.

According to further embodiments of the present disclosure, the tray and tubes are operatively supported at the distal ends thereof by a substantially planar portion of material thereby defining a backboard.

According to further embodiments of the present disclosure, the backboard has advertising or graphics disposed thereupon.

According to further embodiments of the present disclosure, the backboard is configured to be mounted to a secondary structure by means of one of the following; hooks, over-the-door hooks, holes, keyed screw-holes, adhesive material, suction cups, or magnets.

According to further embodiments of the present disclosure, there is a structure disposed upon the tray sized and shaped such that a ball may be placed therein without rolling away thereby defining a hold, with the hold comprising one of the following; a tray, a tray mediated by a door, a tray mediated by a door having a biasing member urging the door closed, a portion of elastic material, or a flexible pocket.

BRIEF DESCRIPTION OF THE FIGURES

In the figures, which are not necessarily drawn to scale, like numerals describe substantially similar components throughout the several views. The drawings illustrate generally, by way of example, but not by way of limitation, various embodiments discussed in the claims of the present document.

FIGS. 3*a*, 3*b*, and 3*c* show show respective top, front, and side views of a second embodiment of a trainer in a first condition.

FIGS. 9*a*, 9*b*, and 9*c* show respective top, front and side views of a second embodiment of a trainer in a first condition.

DETAILED DESCRIPTION OF THE FIGURES

Figure 1:
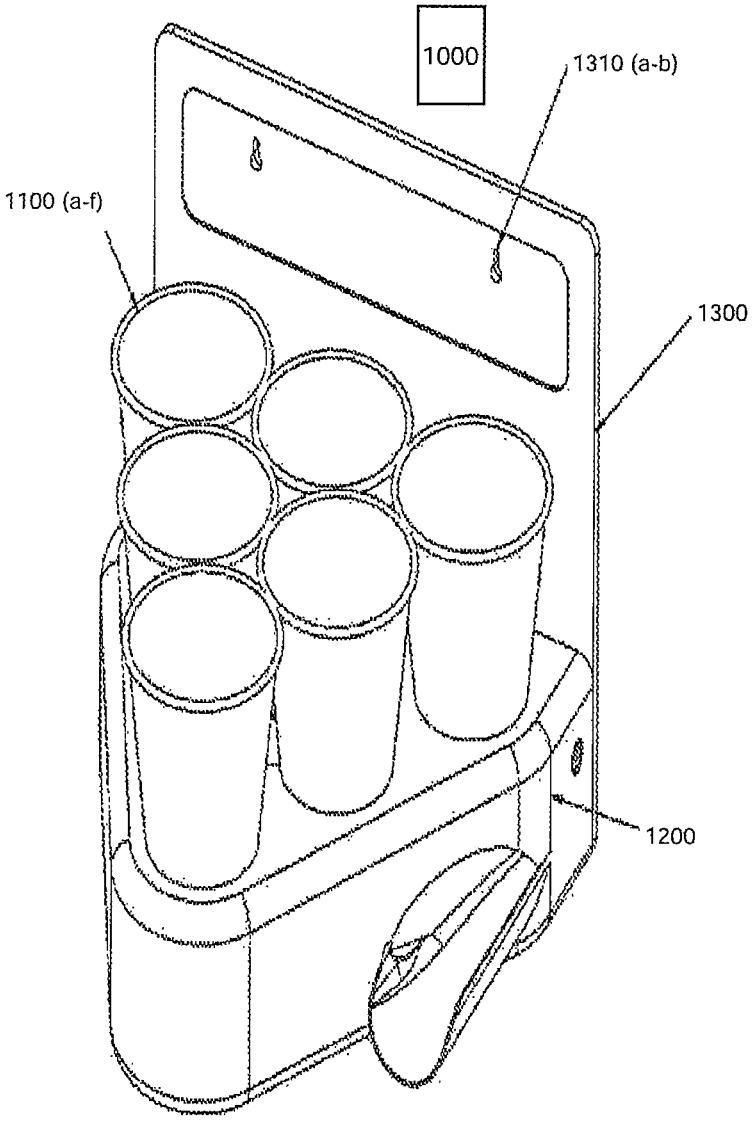
FIG. 1 shows a top-biased isometric view of a first embodiment of a trainer.
Figure 2:
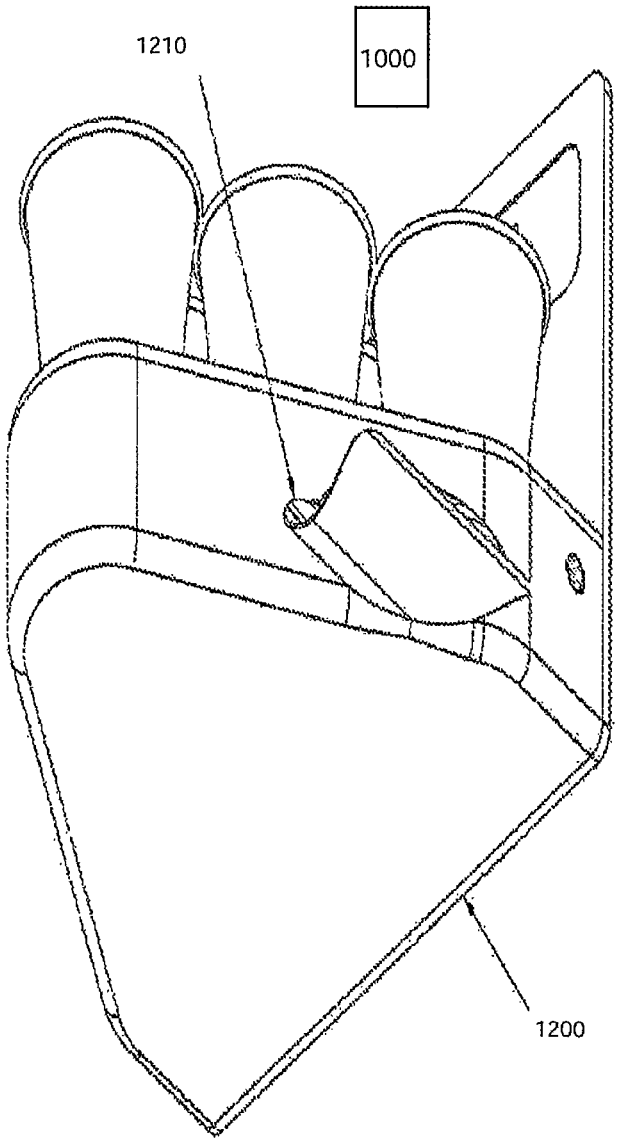
FIG. 2 shows a bottom-biased isometric view of the first embodiment of a trainer.

Various embodiments of the presently disclosed apparatus will now be described in detail with reference to the drawings, wherein like reference numerals identify similar or identical elements. In the drawings and in the description that follows, the term "proximal," will refer to the end of a device or system that is closest to the operator, while the term "distal" will refer to the end of the device or system that is farthest from the operator. Similar, anatomical terms of reference such as dorsal, lateral, anterior, and sagittal shall have their accepted meanings in the arts.

Referring now to FIG. 1, a trainer 1000 is shown having a plurality of receivers 1100(*a-f*) extending ventrally from a base 1200, which has a backboard 1300 at the distal end thereof.

Receivers 1100(*a-f*) are substantially rigid, inverse frustoconical members having a hollow interior. Although the receivers are shown as being frustoconical in shape, there are further embodiments of the present disclosure where the sides of the receivers are either parallel or curved. Backboard 1300 has two keyhold apertures 1310(*a-b*) sized and shaped such that the assembly may be suspended from a surface be means of one or more screws, nails, or hooks.

Figure 4A:
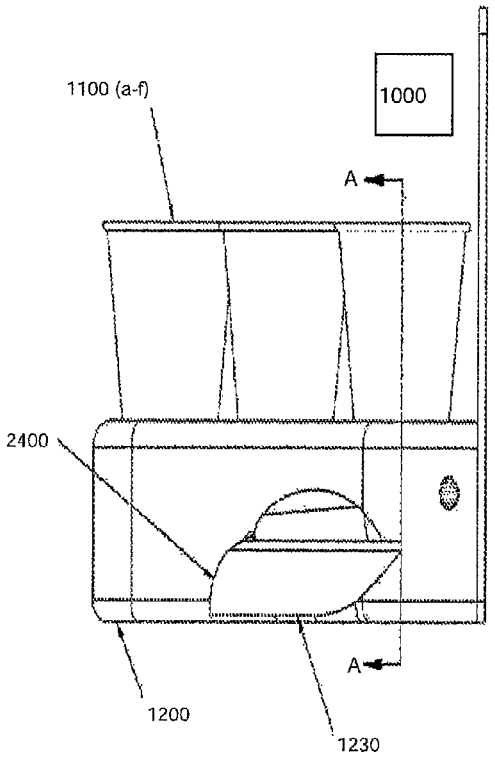
FIGS. 4*a* and 4*b* show an assembled side view and side-section view of a trainer.
Figure 4B:
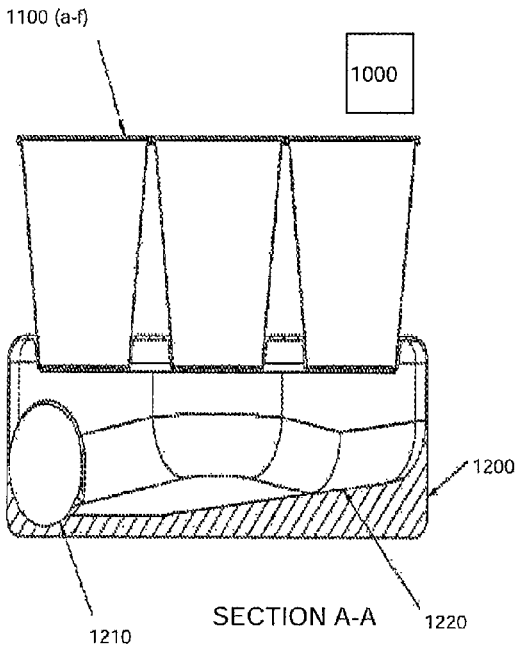
Figure 5A:
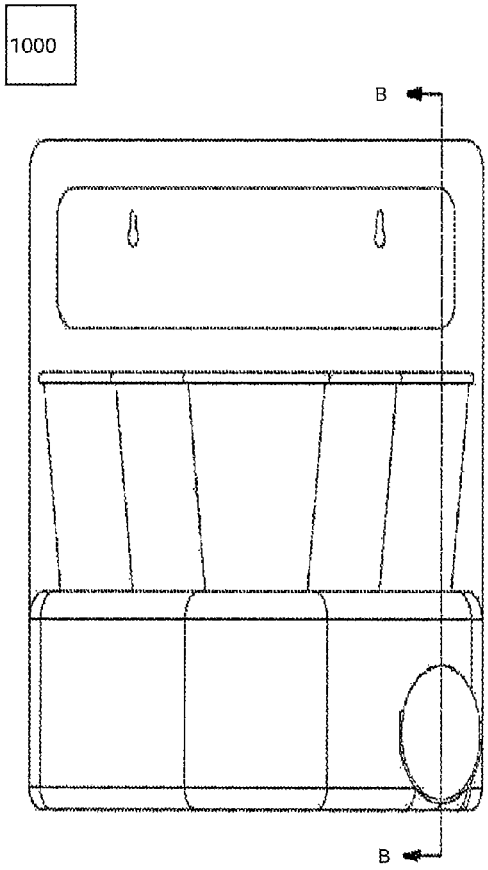
FIGS. 5*a* and 5*b* show an assembled front view and side-section view of a trainer.
Figure 5B:
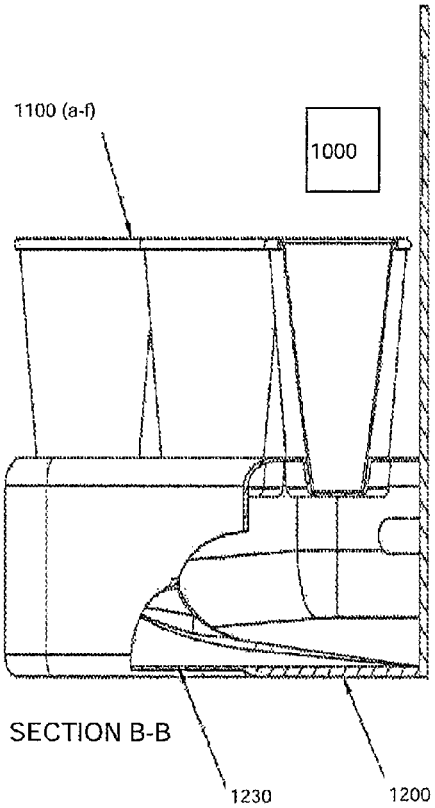

Referring now to FIGS. 4 and 5 together, base 1200 is a hollow body having a shell with a ejection port 1210 disposed on a lateral end portion thereof.

Referring now to FIGS. 4 and 5 together, a cut-away view of a trainer 1000 is shown wherein there are a plurality of internal inclines disposed within the interior volume of base 1200 providing communication between receivers 1100(*a-f*) and port 1210. An initial, lateral incline A, denoted by curve 1220 has its left-hand portion elevated relative to its right-hand portion while a secondary curve B, denoted by curve 1230 has its proximal-end portion elevated relative to its distal-end portion. This arrangement is configured such that a ball released into on of the apertures 1100(*a-f*) will initially fall to incline A, roll to incline B, and from incline B eventually roll to aperture 2400.

Figure 6:
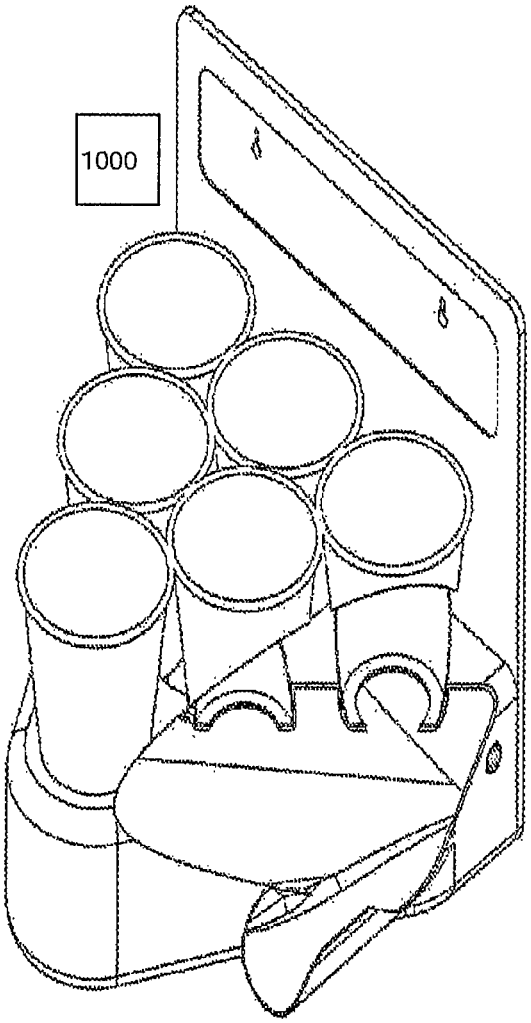
FIG. 6 shows a cut-away section isometric view of a trainer.
Figure 7:
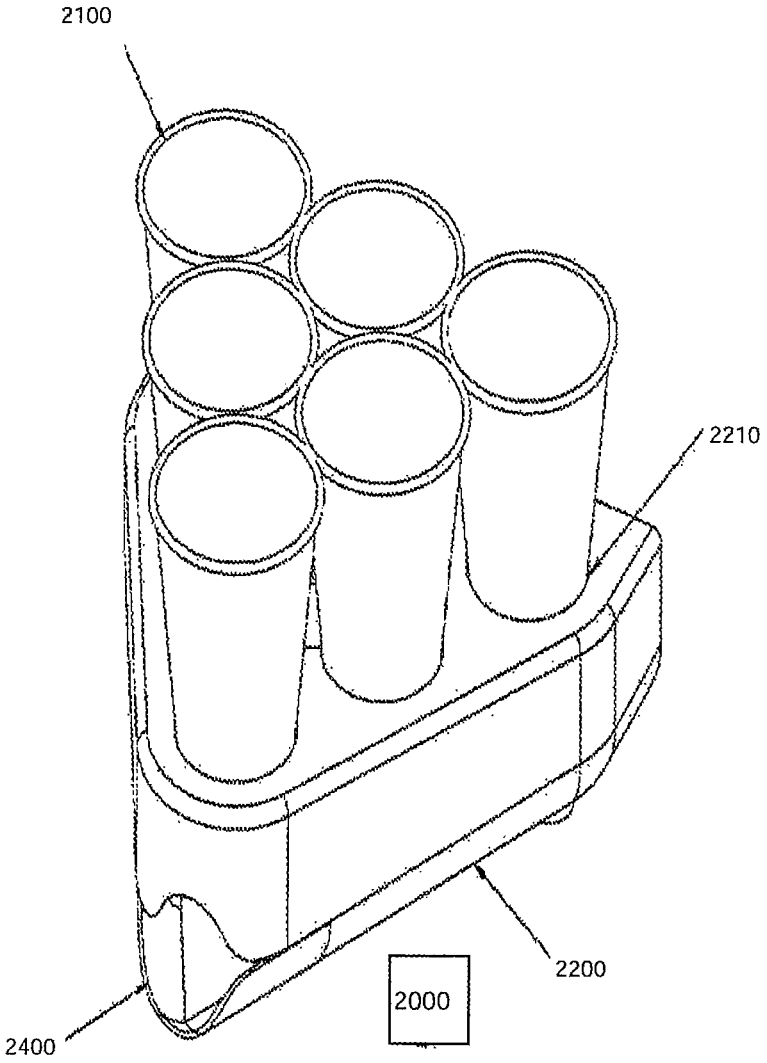
FIG. 7 shows a top-biased isometric view of a trainer.
Figure 8:
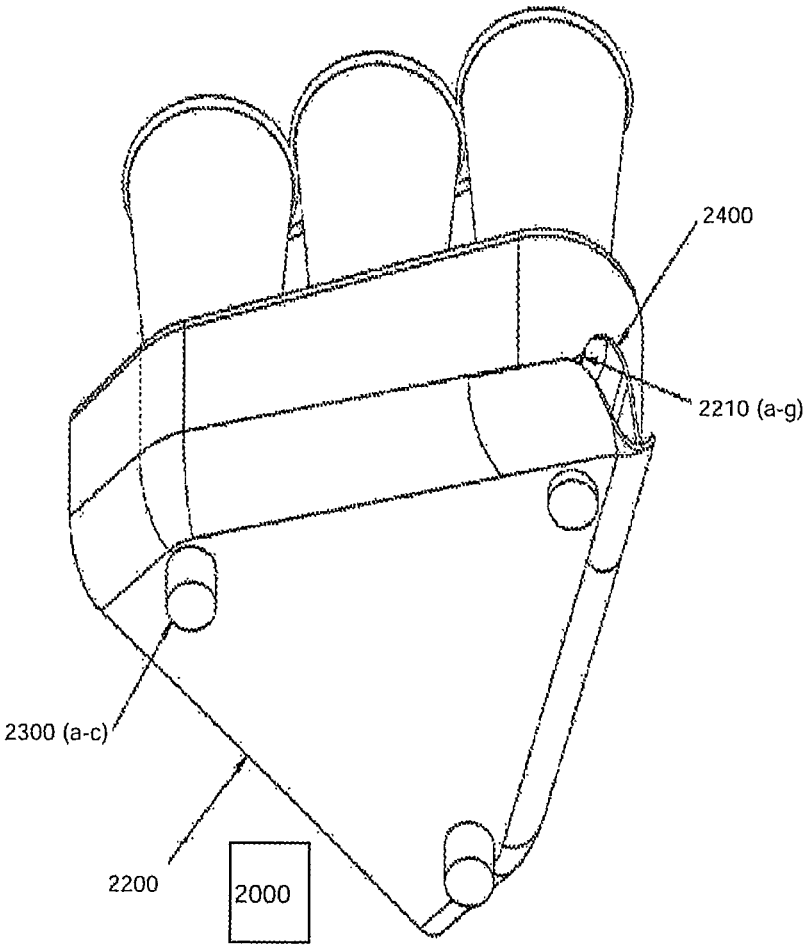
FIG. 8 shows a bottom-biased isometric view of a trainer.

Referring now to FIG. 6, a cut-away front isometric view of a trainer 2000 is shown exposing the slope of the interior plane.

Referring now to FIGS. 7-11 together, a further embodiment of a trainer 2000 is shown, with the trainer comprising at least one receiver 2100 and a base 2200.

Receiver 2100 is a substantially rigid hollow member having a substantially inverse frustoconical shape. Receiver 2100 is press-fit near its ventral end into a complementary aperture 2210(*a*) disposed upon a dorsal-facing surface of body 2200. Although receiver 2100 is shown being press-fit into body 2200, there are further embodiments of the present disclosure within the scope of the appended claims wherein a receiver is coupled to its corresponding base by means of complementary magnets, hook and loop fasteners, threads, a bayonet mount, or adhesive. Further, although trainer 2000 is shown having only one receiver 2100 press-fit one of the apertures, there are further configurations of the present embodiment wherein one or more other receivers occupy the remaining apertures 2210(*b-f*).

Referring now to FIG. 9, the ventral end portion of body 2200 has a plurality of feet 2300(*a-c*) disposed thereupon which elevate the distal-end portion of the body's ventral surface relative to the proximal-end portion of the surface, thereby defining an incline. Further, there is an aperture 2400 disposed upon the proximal-most portion of the body in communication with apertures 2210(*a-f*).

Figure 10A:
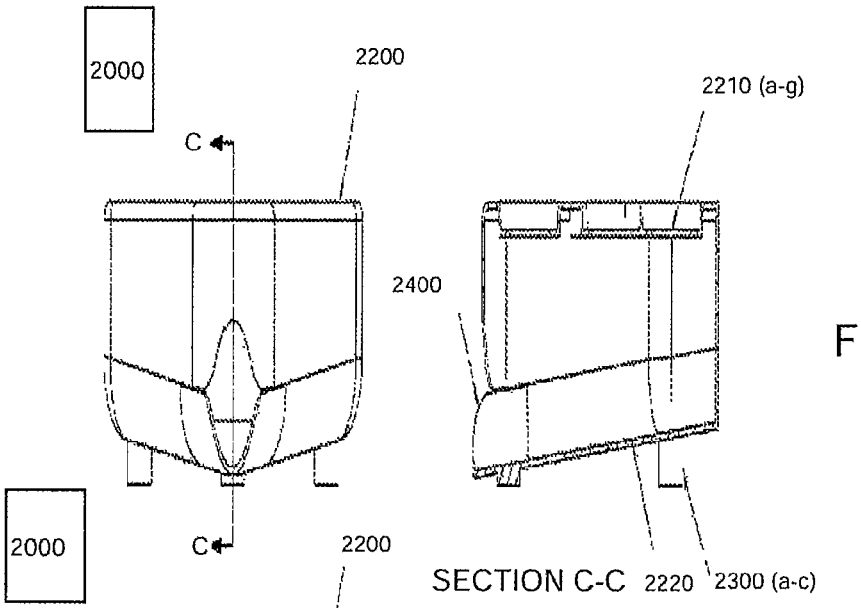
FIGS. 10*a* and 10*b* shows a front and side-section view of a trainer.
Figure 10B:
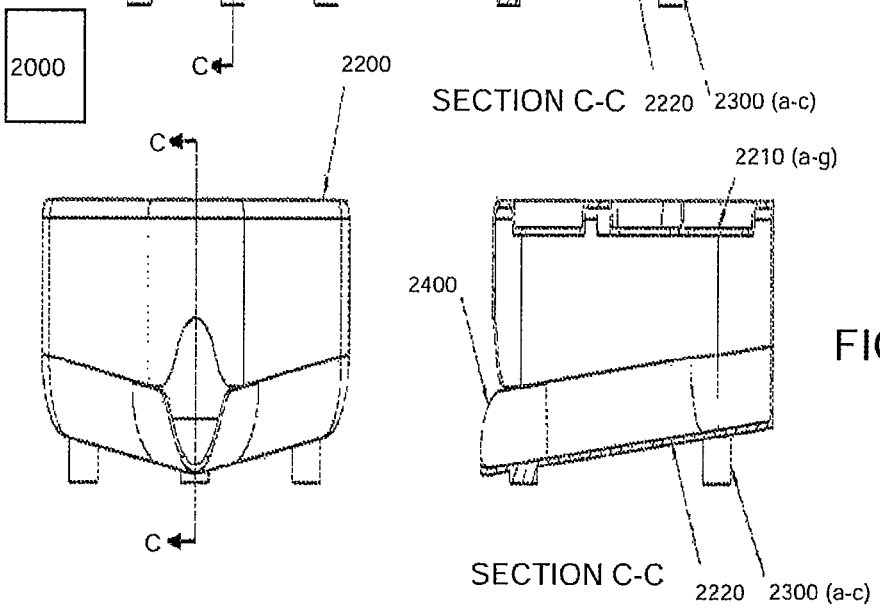

Referring now to FIGS. 10*a* and 10*b* together, a cut-away view of a trainer 2000 is shown. The size and shape of rib 2300 substantially defines an internal incline 2220 that is in communication with apertures 2210(*a-f*) such that a ball released into one of the apertures 2210(*a-f*) will fall and roll to initially incline 2220 and eventually to aperture 2400.

Referring now to FIGS. 14*a*-14*f* together, a plurality of top views of arrangements of apertures within a trainer are shown. These will be apparent to one having ordinary skill in the art as the standard racks for the game Beer Pong. The features of the preceding embodiments may be re-configured so as to arrange the receivers into the configurations shown.

The features described in the preceding sections may be composed of polymers or resins formed by injection molding, roto-molding, or other processes apparent to one having ordinary skill in the art. Further embodiments of the present disclosure may be composed of portions of metals, woods, or fabric as well, so long as the requirement of a plurality of ventral apertures in communication with a proximal-facing aperture is maintained.

Figure 11:
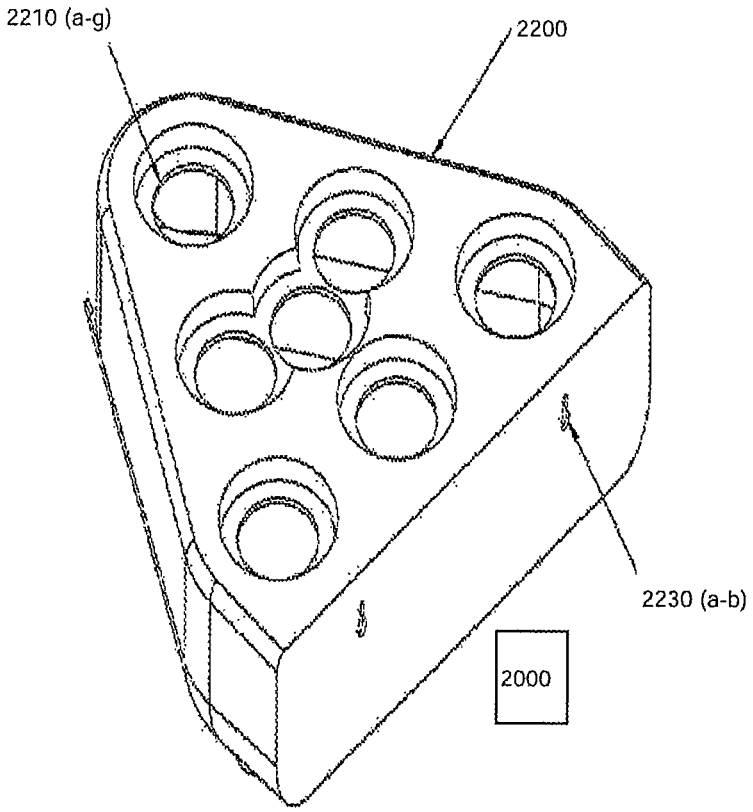
FIG. 11 shows an isometric view of a trainer in a second condition.
Figure 12:
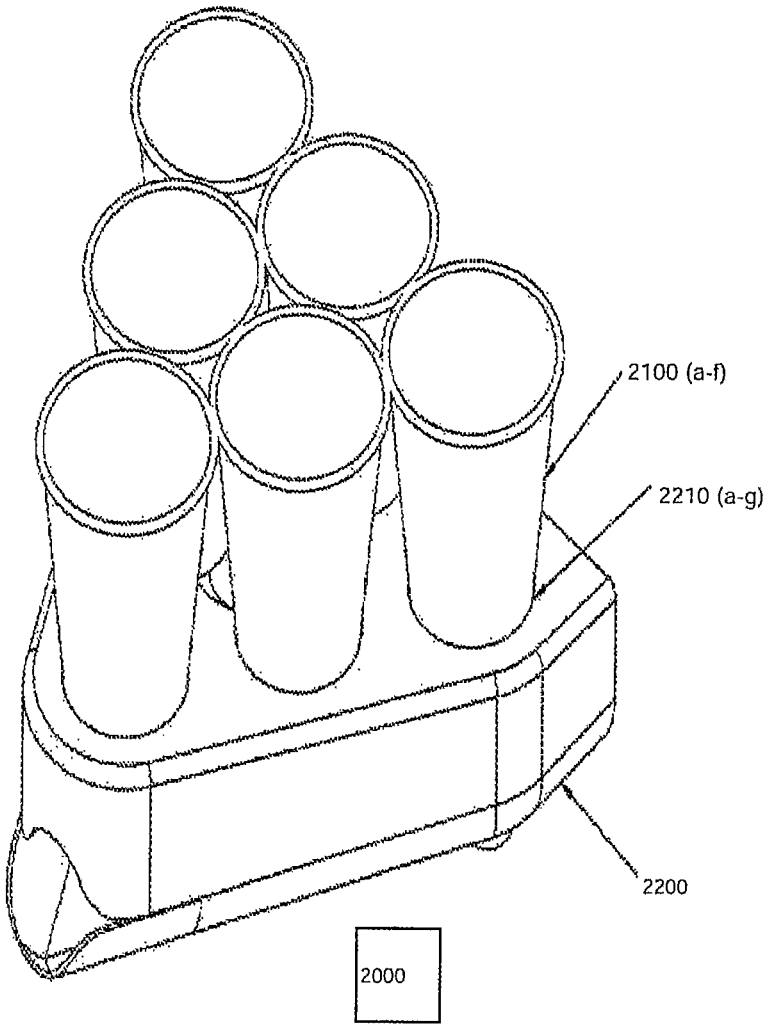
FIG. 12 shows an isometric view of a trainer in a first condition.
Figure 13A:
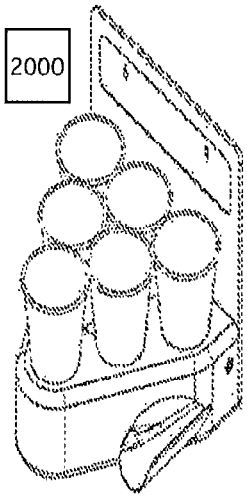
FIGS. 13*a*-13*f* show a trainer as it is configured in various states during the course of use.
Figure 13B:
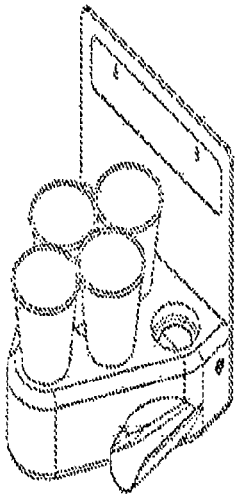
Figure 13C:
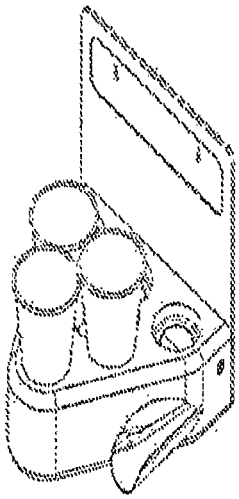
Figure 13D:
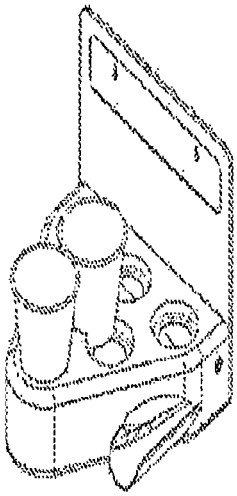
Figure 13E:
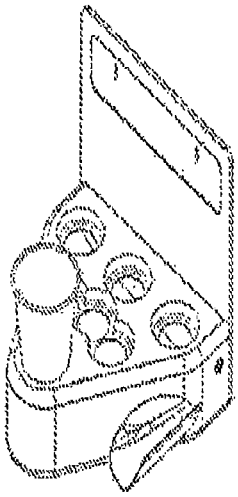
Figure 13F:
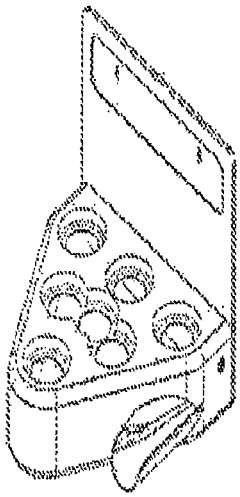
Figure 14A:
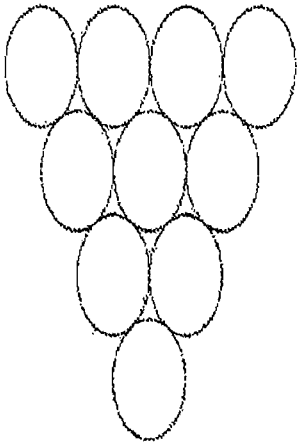
FIGS. 14*a*-14*f* show a top-plan view of various arrangements of elements within a trainer.
Figure 14B:
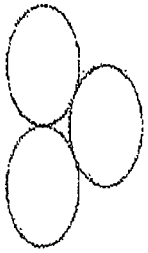
Figure 14C:
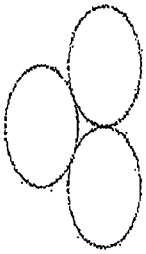
Figure 14D:
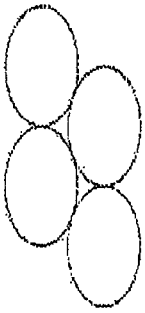
Figure 14E:
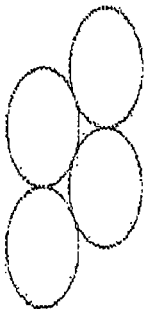
Figure 14F:
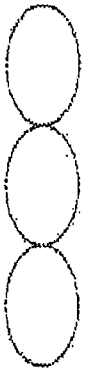

A method of using a trainer 2000 will now be described. A trainer 2000 is provided in an initial condition A, as shown in FIG. 11, wherein there are a plurality of receivers 2100 (*a-f*) disposed within complementary apertures 2210(*a-f*) within body 2000. trainer 2000 is placed on a tabletop at standard height and a distance X from a player. Next, a player tosses a ball with the goal of the ball landing within the ventral-end openings receivers 2100(*a-f*). Each time a player successfully tosses the ball into a receiver 2100(*a-f*), that receiver is removed from the body 2200. When there are 4, 3, 2, and 1 receivers remaining, such are re-arranged into the configurations shown in FIGS. 13*a*-13*f* respectively. Once there are no more receivers remaining, the player has won the game.

What is claimed is:

1. A game system comprising:

a base, wherein said base has an exterior top, bottom, lateral sides, a distal end, and a triangular shape when viewed from the top and bottom, and wherein the top and bottom triangular shapes are congruent with each other and wherein consistent the triangular shapes of the top and bottom there are at least three lateral sides, and wherein one of the at least three sides is associated with the distal end and comprises a substantially vertical planar portion of material that is configured to facilitate mounting to a substantially planar vertical structure, and wherein another one of the at least three lateral sides is an exit side by virtue of the fact that located within the exit side is an exit port, and wherein the exit port is configured such that a ball passing out of the exit port is returning in a direction that is along the exit side and in a direction away from the distal end, and said base is further configured to allow a plurality of receivers to be coupled to said base, wherein associated with the coupling are a plurality of base apertures extending through a top surface of said base, said base including at least one internal surface configured to only return a ball passing through said plurality of base apertures out of the exit port to a common point; and a plurality of receivers, each of said plurality of receivers configured to allow a ball to be thrown into it and to be individually coupled to and extending upwardly from a location at or adjacent one of said plurality of base apertures, and including at least one receiver aperture at a bottommost end thereof, each of said at least one receiver apertures in communication with one of said base apertures.

2. The game system of claim 1, wherein there are at least two internal surfaces comprising a first and second incline and where the first and second inclines are configured such that the ball passing through said base will initially fall onto the first incline and then roll to the second incline prior to exiting out of said base through the exit port.

3. The game system of claim 1, wherein at least one of the group consisting of a color, a diameter, and combinations thereof of the plurality of receivers is selected such that each of said plurality of receivers simulates a clear, red, blue, or white Solo® Plastic Party Cold drinking cup having a size selected from the group consisting of 20 ounce, 16 ounce, 12 ounce, 10 ounce, 9 ounce, and 8 ounce.

4. The game system of claim 1, wherein each of said plurality of receivers has a longitudinal inverse frustoconical taper, the angle of the taper greater than or equal to one degree and less than or equal to thirty degrees.

5. The game system of claim 1, wherein a smallest diameter of each of said plurality of receivers is greater than or equal to one inch and less than or equal to four inches.

6. The game system of claim 1, including six of said plurality of receivers arranged in a triangular configuration.

7. The game system of claim 1, wherein said coupling is configured to be removably coupled.

8. The game system of claim 1, wherein said game system is a game system for playing beer pong without throwing a ball into a cup of a liquid that is to be consumed.

9. The game system of claim 1, wherein said plurality of receivers are substantially circular tangential and co-planar.

* * * * *